US010056092B2

(12) United States Patent
Buck et al.

(10) Patent No.: US 10,056,092 B2
(45) Date of Patent: Aug. 21, 2018

(54) RESIDUAL INTERFERENCE SUPPRESSION

(71) Applicant: NUANCE COMMUNICATIONS, INC., Burlington, MA (US)

(72) Inventors: Markus Buck, Biberach (DE); Tobias Wolff, Neu Ulm (DE); Naveen Kumar Desiraju, Ulm (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 0 days.

(21) Appl. No.: 15/508,140

(22) PCT Filed: Sep. 12, 2014

(86) PCT No.: PCT/US2014/055329
§ 371 (c)(1),
(2) Date: Mar. 2, 2017

(87) PCT Pub. No.: WO2016/039765
PCT Pub. Date: Mar. 17, 2016

(65) Prior Publication Data

US 2017/0287502 A1 Oct. 5, 2017

(51) Int. Cl.
*G10L 21/0232* (2013.01)
*G10L 25/21* (2013.01)
(Continued)

(52) U.S. Cl.
CPC ..... *G10L 21/0232* (2013.01); *G10L 25/21* (2013.01); *G10L 2021/02082* (2013.01); *G10L 2021/02166* (2013.01)

(58) Field of Classification Search
CPC ..... G10L 21/0232; G10L 2021/02165; G10L 2021/02166; G10L 2021/02082; G10L 25/21; H04M 9/082
See application file for complete search history.

(56) References Cited

U.S. PATENT DOCUMENTS

2004/0264686 A1* 12/2004 Enzner ..... H04M 9/082 379/406.08
2005/0063536 A1* 3/2005 Myllyla ..... H04M 9/082 379/406.08

(Continued)

FOREIGN PATENT DOCUMENTS

WO WO 2004/008731 1/2004
WO WO 2008/045332 4/2008

OTHER PUBLICATIONS

Breining et al. Acoustic Echo Control An Application of Very-High-Order Adaptive Filters; IEEE Signal Processing Magazine, Jul. 1999; pp. 42-69 (28 pages).

(Continued)

*Primary Examiner* — Jason R Kurr
(74) *Attorney, Agent, or Firm* — Daly, Crowley Mofford & Durkee, LLP

(57) ABSTRACT

Methods and apparatus for estimating the power spectral density (PSD) of a residual interference having first and second components after adaptive interference cancellation (AIC). The first component can be estimated using a real-valued FIR filter operating on a time series of PSD estimates of a reference signal, and the second component can be estimated using an exponential decay over time corresponding to a reverberation time using the PSD of the reference signal.

18 Claims, 12 Drawing Sheets

(51) Int. Cl.
*G10L 21/0208* (2013.01)
*G10L 21/0216* (2013.01)

(56) References Cited

U.S. PATENT DOCUMENTS

| | | | | |
|---|---|---|---|---|
| 2005/0118956 | A1 | 6/2005 | Haeb-Umbach et al. | |
| 2010/0074452 | A1 | 3/2010 | Adeney et al. | |
| 2011/0182436 | A1 | 7/2011 | Murgia et al. | |
| 2013/0301840 | A1* | 11/2013 | Yemdji | H04M 9/082 381/66 |
| 2014/0177859 | A1* | 6/2014 | Ahgren | H04R 3/002 381/71.1 |
| 2015/0371659 | A1* | 12/2015 | Gao | G10L 21/0208 704/226 |

OTHER PUBLICATIONS

Habets et al. "Joint Dereverberation and Residual Echo Suppression of Speech Signals in Noisy Environments"; IEEE Transactions on Audio, Speech, and Language Processing, vol. 16, No. 8, Nov. 2008; pp. 1433-1451 (19 pages).

Schmidt: "Applications of Acoustic Echo Control—An Overview", Temic SDS, Research, Germany, 2004; pp. 9-16 (8 pages).

Valero et al.: "Signal-Based Late Residual Echo Spectral Variance Estimation"; IEEE International Conference on Acoustic, Speech and Signal Processing, 2014; pp. 5955-5959 (5 pages).

Tobias Wolff et al: "Influence of blocking matrix design on microphone array postfilters"; Nuance Communications, Ulm, Germany, 2010, 4 pages.

Tomita et al.: "Equation errors versus output error methods"; Ergonomics, 1992, vol. 35, 551-564 (14 pages).

Tobias Wolff et al.: "A generalized view on microphone array postfilters"; Nuance Communications, Ulm, Germany, 2010; 4 pages.

International Search Report and Written Opinion dated May 28, 2015; for PCT/US2014/055329; 11 pages.

PCT International Preliminary Report dated Mar. 23, 2017 for International Application No. PCT/US2014/055329; 8 Pages.

* cited by examiner

RESIDUAL INTERFERENCE SUPPRESSION

CROSS REFERENCE TO RELATED APPLICATIONS

This application is a National Stage application of PCT/US2014/055329 filed on Sep. 12, 2014, and entitled "Residual Interference Suppression", which is incorporated herein by reference.

BACKGROUND

As is known in the art, adaptive interference cancellation (AIC) can form a part of acoustic echo cancellation, adaptive beam forming, adaptive noise cancellation, etc. AIC uses adaptive filters to model the acoustic (reverberant) channel of the interfering signal component. The estimate of the interference component is then subtracted ("cancelled") from the input signal without distorting the desired signal component. Nevertheless, some residual interference remains after AIC. In many conventional systems, residual interference suppression (RIS) is applied after AIC, which performs spectral weighting on the AIC output.

SUMMARY

Embodiments of the invention provide methods and apparatus for providing an enhanced estimation of the power of the residual interference component after AIC by achieving a higher accuracy for less speech distortion than conventional techniques. By using inventive RIS processing, a better signal quality (i.e. a better trade-off between distortion of the desired signal and suppression of the interference) is achieved. Thus, an improved ASR performance for barge-in applications (AEC) and for beamformer post filtering is achieved.

After AIC, the residual component of the interference includes multiple parts. One part is due to the limited length of the adaptive filter: the full length of the acoustic path cannot be modeled and late echoes cannot be cancelled with AIC. Another part is due to a misalignment of the adaptive filter: as the acoustic path changes over time the filter has to adapt permanently and is never perfectly converged.

Conventional systems apply post-filters (dynamic spectral weighting) after AIC where the post-filtering weighting factors are calculated based on estimates of the power of the residual interference after the AIC. Embodiments of the invention improve the accuracy of the power estimate based on an inventive parametric model. With the inventive processing, improved speech enhancement (less speech distortion) and improved ASR performance are achieved.

Embodiments of the invention can also provide adaptation control of the filters within the AIC to allow for a more precise estimate of the misalignment of the filter which is required to calculate the optimal step size for filter adaptation. This improves the AIC performance.

It is understood that embodiments of the invention are applicable to a wide range of applications, such as ASR and hands-free telephony applications, barge-in, acoustic echo cancellation, multichannel reverberation suppression, and the like.

In one aspect of the invention, a method for estimating reverberant spectral variance (RSV) comprises: estimating a power spectral density of residual interference after adaptive interference cancellation (AIC) using first and second components; estimating the first component using a real-valued FIR filter operating on a power spectral density (PSD) of a reference signal; and estimating the second component using an exponential decay over time corresponding to a reverberation time using the PSD of the reference signal.

The method can further include one or more of the following features: using a FIR filter for the first component and using an IIR filter for the second component, the FIR alter has a number of taps, the IIR filter includes a delay element with the delay equal to the length of the FIR filter, determining a common scaling factor for the taps, using gradient descend processing to find the first and/or second component, using equation error principle processing, using a logarithmic cost function for the gradient descend processing, determining parameters A, B, and C and compensating the first component, which corresponds to an early reverberation PSD, from an observed PSD, to drive the adaptation of the parameter B, where the parameter A is a scaling parameter corresponding to a strength of late reverberation, the parameter B describes exponential decay in relation to reverberation time of an enclosure and the parameter C is a common scaling factor for filter time lags, determining the parameter B by extrapolating a log of an AEC filter response linearly and using the resulting late reverb-PSD jointly with an FIR Model for the first component, controlling a step size of the adaptation AIC filter, dynamically adjusting a length of the FIR filter corresponding to a reverberation time and/or the ratio of early and late residual interference, the reference signal comprises a loudspeaker signal and the RSV estimate is applied for residual echo suppression, and/or the reference signal comprises a microphone signal and the second component corresponding to late RSV is used for dereverberation.

In another aspect of the invention, an article comprises: a non-transitory storage medium having stored instructions that enable a machine to estimate reverberant spectral variance (RSV), comprising instructions to: estimate a power spectral density of residual interference after adaptive interference cancellation (AIC) using first and second components; estimate the first component using a real-valued FIR filter operating on a power spectral density (PSD) of a reference signal; and estimate the second component using an exponential decay over time corresponding to a reverberation time using the PSD of the reference signal.

The article can further include one or more of the following features: using a FIR filter for the first component and using an IIR filter for the second component, the FIR filter has a number of taps, the IIR filter includes a delay element with the delay equal to the length of the FIR filter, determining a common scaling factor for the taps, using gradient descend processing to find the first and/or second component, using equation error principle processing, using a logarithmic cost function for the gradient descend processing, determining parameters A, B, and C and compensating the first component, which corresponds to an early reverberation PSD, from an observed PSD, to drive the adaptation of the parameter B, where the parameter A is a scaling parameter corresponding to a strength of late reverberation, the parameter B describes exponential decay in relation to reverberation time of an enclosure and the parameter C is a common scaling factor for filter time lags, determining the parameter B by extrapolating a log of an AEC filter response linearly and using the resulting late reverb-PSD jointly with an FIR Model for the first component, controlling a step size of the adaptation AIC filter, dynamically adjusting a length of the FIR filter corresponding to a reverberation time and/or the ratio of early and late residual interference, the reference signal comprises a loudspeaker signal and the RSV estimate is applied for residual echo suppression, and/or the reference signal comprises a microphone signal and the second component corresponding to late RSV is used for dereverberation.

In a further aspect of the invention, a system comprises: an AIC module to receive an input signal and a reference signal and generate an AIC output signal; a first PSD module to receive the AIC output signal and generate a first PSD output signal; a second PSD module to receive the reference signal and generate a second PSD output signal; an early and late residual interference PSD estimation module to receive the second PSD output signal and generate an early residual interference output and a late residual interference output, the early and late residual interference PSD estimation module configured to generate the early residual interference output using a real-valued FIR filter operating on a power spectral density (PSD) of the reference signal, and to generate the late residual interference output using an exponential decay over time corresponding to a reverberation time using the PSD of the reference signal; and a residual echo suppression module to process the early residual interference output, the late residual interference output, and the AIC output.

The system can be further configured to include one or more of the following features: using a FIR filter for the first component and using an IIR filter for the second component, the FIR filter has a number of taps, the IIR filter includes a delay element with the delay equal to the length of the FIR filter, determining a common scaling factor for the taps, using gradient descend processing to find the first and/or second component, using equation error principle processing, using a logarithmic cost function for the gradient descend processing, determining parameters A, B, and C and compensating the first component, which corresponds to an early reverberation PSD, from an observed PSD, to drive the adaptation of the parameter B, where the parameter A is a scaling parameter corresponding to a strength of late reverberation, the parameter B describes exponential decay in relation to reverberation time of an enclosure and the parameter C is a common scaling factor for filter time lags, determining the parameter B by extrapolating a log of an AEC filter response linearly and using the resulting late reverb-PSD jointly with an FIR Model for the first component, controlling a step size of the adaptation AIC filter, dynamically adjusting a length of the FIR filter corresponding to a reverberation time and/or the ratio of early and late residual interference, the reference signal comprises a loudspeaker signal and the RSV estimate is applied for residual echo suppression, and/or the reference signal comprises a microphone signal and the second component corresponding to late RSV is used for dereverberation.

In a further aspect of the invention, a system comprises: an AIC module to receive an input signal and a reference signal and generate an AIC output signal; a first PSD module to receive the AIC output signal and generate a first PSD output signal; a second PSD module to receive the reference signal and generate a second PSD output signal; an early and late residual interference PSD estimation module to receive the second PSD output signal and generate an early residual interference output and a late residual interference output, the early and late residual interference PSD estimation module configured to generate the early residual interference output using a real-valued FIR filter operating on a power spectral density (PSD) of the reference signal, and to generate the late residual interference output using an exponential decay over time corresponding to a reverberation time using the PSD of the reference signal; a beamforming module to receive the input signal and the reference signal and generate a beamforming output signal; and a dereverberation module to process the late residual interference output and the beamforming output, wherein the early residual interference output is not processed by the dereverberation module.

The system can be further configured to include one or more of the following features: using a FIR filter for the first component and using an IIR filter for the second component, the FIR filter has a number of taps, the IIR filter includes a delay element with the delay equal to the length of the FIR filter, determining a common scaling factor for the taps, using gradient descend processing to find the first and/or second component, using equation error principle processing, using a logarithmic cost function for the gradient descend processing, determining parameters A, B, and C and compensating the first component, which corresponds to an early reverberation PSD, from an observed PSD, to drive the adaptation of the parameter B, where the parameter A is a scaling parameter corresponding to a strength of late reverberation, the parameter B describes exponential decay in relation to reverberation time of an enclosure and the parameter C is a common scaling factor for filter time lags, determining the parameter B by extrapolating a log of an AEC filter response linearly and using the resulting late reverb-PSD jointly with an FIR Model for the first component, controlling a step size of the adaptation AIC filter, dynamically adjusting a length of the FIR filter corresponding to a reverberation time and/or the ratio of early and late residual interference, the reference signal comprises a loudspeaker signal and the RSV estimate is applied for residual echo suppression, and/or the reference signal comprises a microphone signal and the second component corresponding to late RSV is used for dereverberation.

BRIEF DESCRIPTION OF THE DRAWINGS

The foregoing features of this invention, as well as the invention itself, may be more fully understood from the following description of the drawings in which.

DETAILED DESCRIPTION

Figure 1:
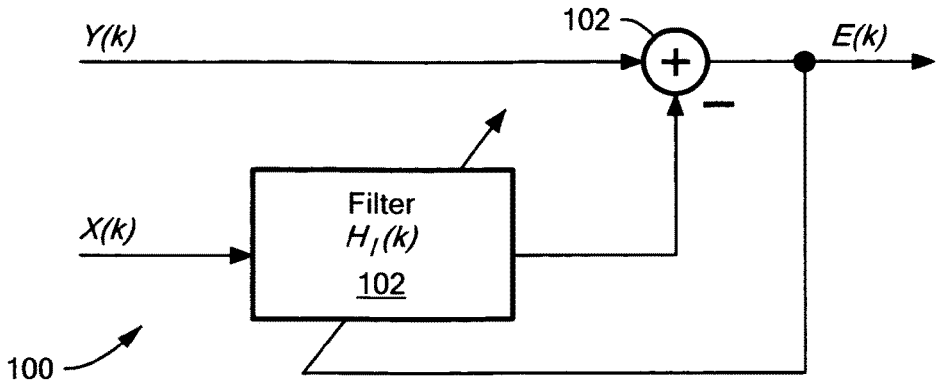
FIG. 1 is a schematic representation of an adaptive interference cancellation (AIC) system.

FIG. 1 shows a high level system 100 having adaptive interference cancellation (AIC) in accordance with illustrative embodiments of the invention. In the illustrated embodiment, the AIC system 100 receives a reference signal X(k) for the interference that is filtered by a D-tap adaptive filter 102 $H_l(k)$, and then subtracted from the AIC input signal Y(k). E(k) is the error signal after subtraction, computed as follows:

$$E(k) = Y(k) - \sum_{l=0}^{D-1} H_l^*(k)X(k-l) \tag{1}$$

If $H_l(k)$ replicates the transmission characteristics of the interference from its source to the microphone, then subtraction can completely remove the interfering component from the microphone signal Y(k).

In the illustrated embodiment, processing is performed in the short-time Fourier domain with k being the frame index. The frequency index is omitted in the text for better readability. All signals and filter taps are generally complex values. Conjugate complex signals are indicated by an exposed star (*).

In many speech enhancement applications interfering signal components superpose the desired speech signal. In some cases a reference signal of the interfering sound source is available. An interfering source can include, e.g., a loudspeaker, or even parts of the desired signal such as reverberation. Then adaptive interference cancellation (AIC) can be applied.

Figure 1A:
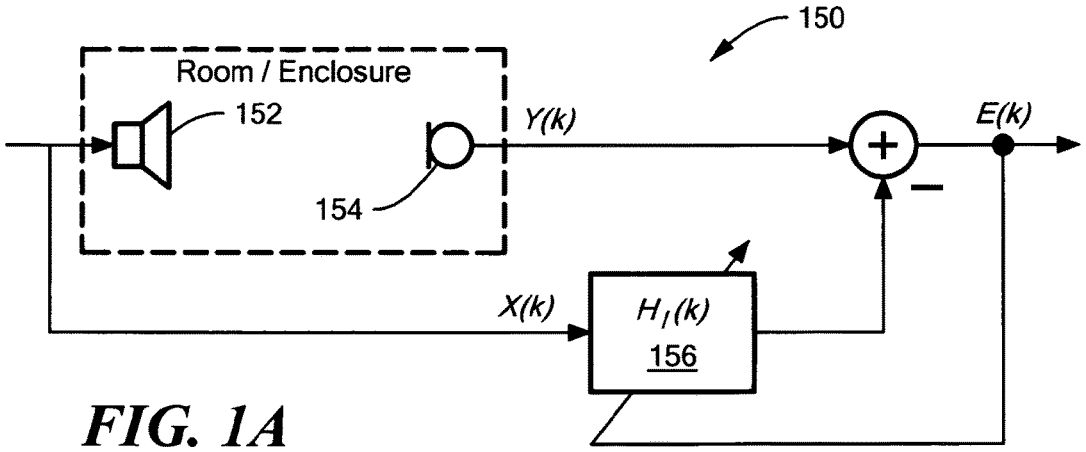
FIG. 1A is a schematic representation of a AIC system for acoustic echo cancellation.

FIG. 1A shows a system 150 having acoustic echo cancellation (AEC), where X(k) is the playback signal of a loudspeaker 152 and Y(k) is the microphone signal that includes the echo of the loudspeaker coupling over the room into the microphone 154. The AIC structure 156 models the transmission characteristics of the interference from the loudspeaker to the microphone.

Figure 1B:
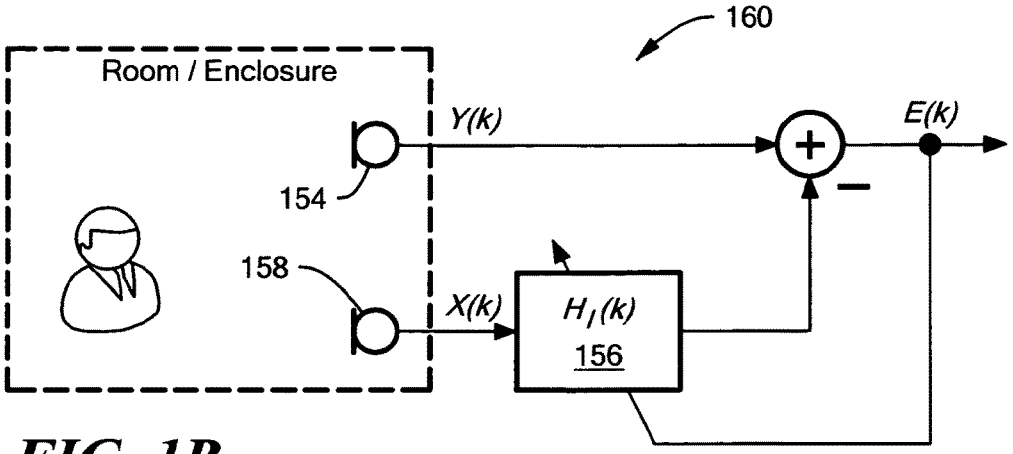
FIG. 1B is a schematic representation of a AIC system for adaptive signal blocking (e.g. in the context of adaptive beamforming)

FIG. 1B shows a further AIC system 160 for signal blocking (e.g. in the context of adaptive beamforming). In the context of adaptive beamforming, the AIC structure 156 filters out the direct component of the speech signal so that the remaining signal components (typically noise) can be reduced at the output of a fixed beamformer (Generalized Sidelobe Canceller), for example. In a non reverberant environment, signal blocking can be achieved by simple subtraction of time-aligned adjacent microphone signals (in this case the AIC filter H(k) performs the temporal alignment). In the general case of reverberant environments, the AIC structure can be applied for more accurate cancellation of the early reverberant components. Also the term "Blocking matrix" is used in the context of the Generalized Sidelobe Canceller.

FIG. 1B has some commonality with the system of FIG. 1A. The illustrated system 160 provides direct sound blocking. In the context of beamforming or signal blocking, X(k) is to a microphone 158 signal. For computational complexity considerations, the length D of the adaptive filters within the AIC is usually chosen to be relatively short. Therefore, the full length of the acoustic impulse response is not represented by the AIC. As a consequence late echoes (late reverberation) cannot be compensated by AIC and remain in the output signal.

The residual interference component includes a number of components. One component is due to a not fully converged adaptive filter (time lags from 0 up to D−1). Another component (time lags larger or equal than D) is present since it cannot be covered by the adaptive filter due to the finite length of the filter. If the AIC-filter is not converged at all, the first part of the residual interference may actually be the complete interference.

For dereverberation often a time lag of 50 ms is used to distinguish early and late reverberation. Reverberation arriving no later than 50 ms is usually referred to as early reverberation (or early reflections), whereas all reverberation arriving after the 50 ms boundary is referred to as late reverberation. This is mainly motivated by psychoacoustic effects. For AEC applications the length of the adaptive filter D is often chosen according to the reverberation time of the enclosure. In living rooms values of 300 ms might be chosen whereas in cars shorter filters with 50 ms might be sufficient.

Figure 2:
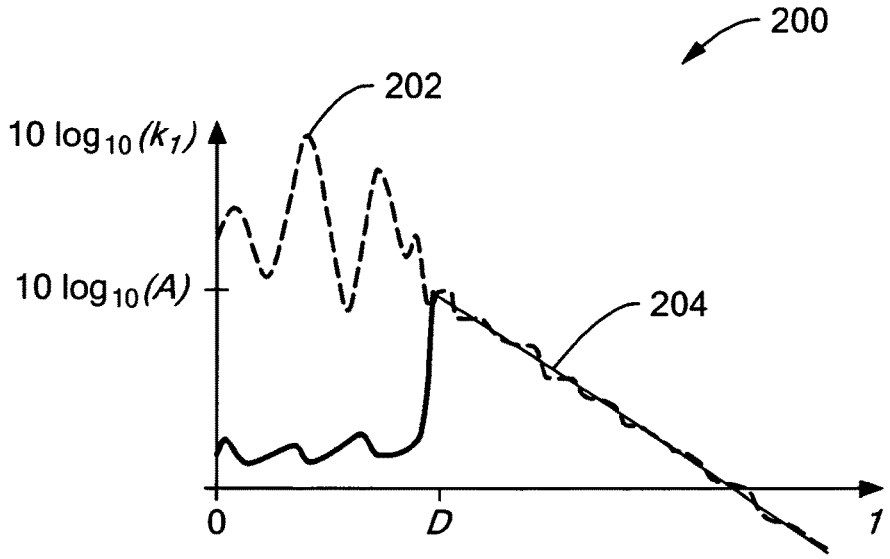
FIG. 2 is a schematic representation of a graphical representation of a convolutive model for residual interference power spectral density (PSD)

FIG. 2 shows a plot 200 of logarithmic amplitude versus filter time lag for a convolutive model $K_l$ for the residual interference. Dashed line 202 shows the impulse response $K_l$ that connects the PSD (power spectral density) of the residual interference Φrr and the PSD of the reference Φxx by convolution. It can be seen that the PSD of the late part can be well described by an exponential decay, whereas the early part generally requires more parameters. The solid line 204 shows what is represented by the inventive model for the case of an almost converged AIC-Filter: The first coefficients of $K_l$ are nearly identical and the late ones decay exponentially.

Embodiments of the invention provide estimation of the reverberant spectral variance (RSV) at the AIC output. It is understood that RSV is identical to the term PSD of the residual interference. In particular, embodiments estimate early and late RSV parts jointly. Embodiments can be applied to residual echo suppression for acoustic echo cancellation and dereverberation in the context of beamforming, for example.

The residual error after adaptive interference cancellation is modelled in the power domain, as follows:

$$\tilde{\Phi}_{rr}(k) = \sum_{l=0}^{\infty} \Phi_{xx}(k-l)K_l, \tag{2}$$

where $\tilde{\Phi}$rr(k) is the PSD of the residual interference component after AIC. $K_l$ is a frame-based scalar weighting factor which refers to the contribution of the PSD of the reference signal Φxx(k) of the recent frames. The residual interference PSD is separated into two parts: the first part (time lags 0, . . . , D−1) refers to the region which is covered by the adaptive AIC filter of length D and the second part (time lags D, . . . ) refers to the time lags which cannot be modelled by the AIC filter (due to its finite length D), as set forth below:

$$\tilde{\Phi}_{rr}(k)=\tilde{\Phi}_{\epsilon\epsilon}(k)+\tilde{\Phi}_{LL}(k) \quad (3)$$

The first part $\tilde{\Phi}_{\epsilon\epsilon}(k)$ contributes due to misalignment of the adaptive filter and the second part $\tilde{\Phi}LL(k)$ contributes due to the late reverberation tail (Eq. 2). Modelling the PSD of the residual interference with the first and second parts provides enhanced performance in comparison with conventional processing.

Figure 3:
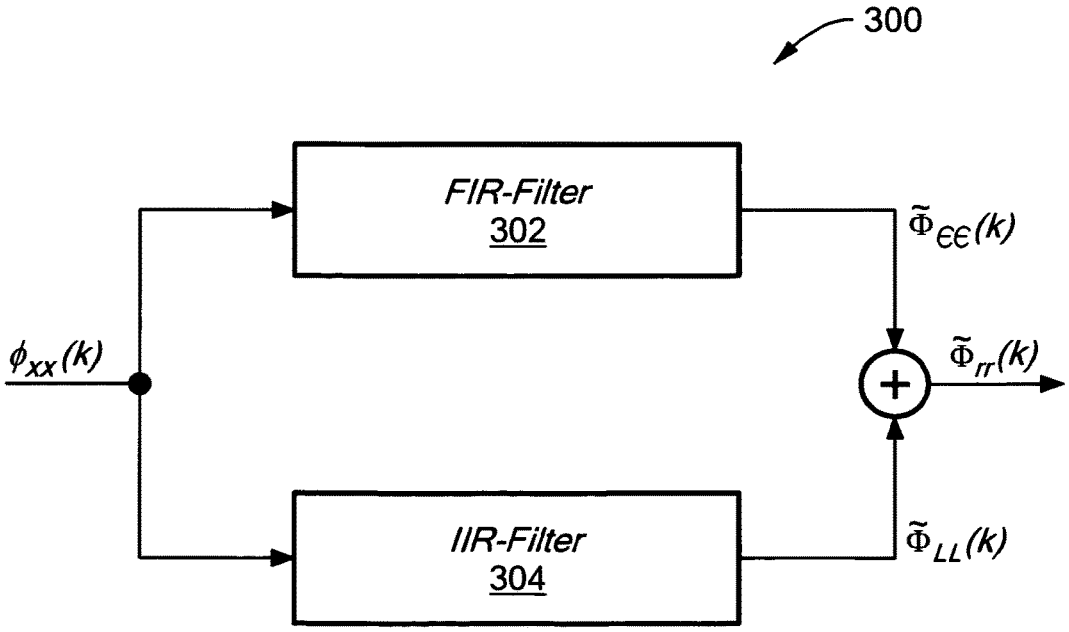
FIG. 3 is a schematic representation for a residual interference PSD having a early components processed with a FIR filter and late components processed with a IIR filter.

FIG. 3 shows an illustrative implementation 300 for processing residual interference PSD. The early components are modelled using an FIR filter 302 and the late parts are represented by an IIR filter 304. The reference signal $\Phi xx(k)$ of the recent frames is provided to the FIR filter 302, which outputs $\tilde{\Phi}\epsilon\epsilon(k)$, and the IIR filter 304, which outputs $\tilde{\Phi}_{LL}(k)$. $\tilde{\Phi}\epsilon\epsilon(k)$ and $\tilde{\Phi}_{LL}(k)$ are combined to generate $\tilde{\Phi}rr(k)$.

Figure 4:
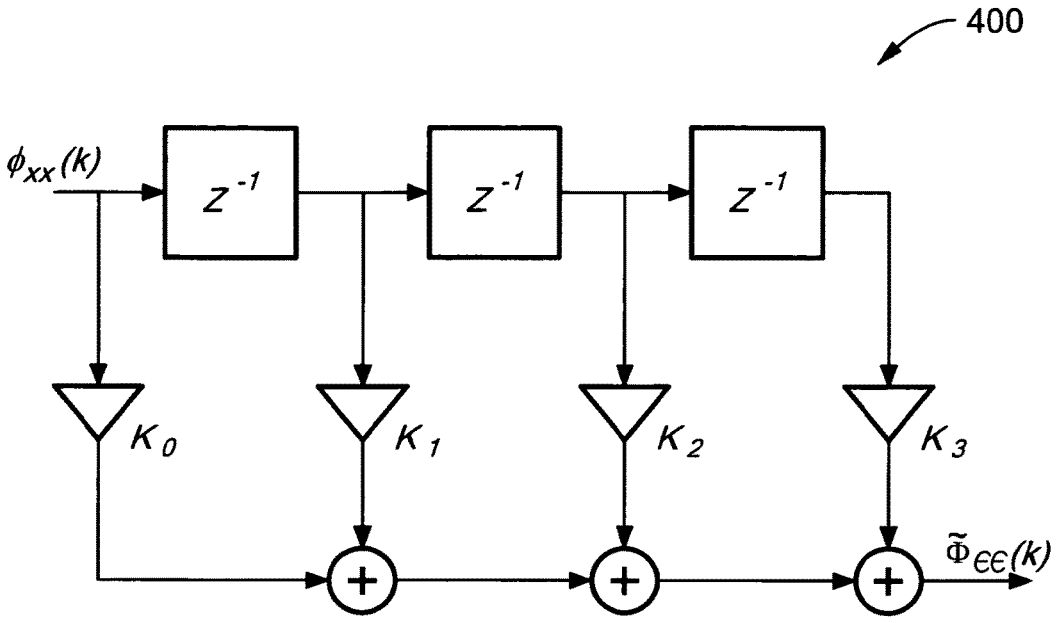
FIG. 4 is a schematic representation of a FIR filter for early residual PSD.

FIG. 4 shows a representation of a first part as a D-tap real-valued FIR filter 400 which operates on the PSD of the reference signal, as follows:

$$\tilde{\Phi}_{\epsilon\epsilon}(k)=\sum_{l=0}^{D-1}\Phi_{xx}(k-l)K_l \quad (4)$$

Conventional processing uses a simple "coupling factor" which scales the PSD of the reference signal (or a smoothed version of this PSD). This coupling factor has either no temporal context at all, or the temporal context spreads out infinitely long when recursive smoothing is applied.

In contrast to this conventional processing, FIG. 4 shows an illustrative FIR filter 400 for estimating the early residual interference PSD in which the temporal context in the inventive FIR implementation matches the one of the early residual. As can be seen, the FIR filter implementation has D=4 coefficients, shown as K1, K2, K3, K4.

The FIR model can be simplified by the assumption that $K_l$ is expected to show equal values for all time lags (at least when $H_l(k)$ has converged sufficiently). It is assumed that the misalignment of the adaptive filter coefficients is equally distributed over all taps. Thus, we can apply a common scaling factor C for all time lags as follows:

$$K_l=C, \text{ for } l=0, \ldots, D-1.$$

So then:

$$\tilde{\Phi}_{\epsilon\epsilon}(k)=C\cdot\sum_{l=0}^{D-1}\Phi_{xx}(k-l) \quad (5)$$

For the second part $\tilde{\Phi}_{LL}(k)$, i.e., late reverberant spectral variance, the residual interference is represented by a parametric model that describes an exponential decay over time: $K_l=A\cdot B^l$, for $l\geq D$, where B is between 0 and 1 and is closely related to the reverberation time T60 of the enclosing room. A is a scaling parameter that represents the strength of the late reverberation. As set forth below:

$$\tilde{\Phi}_{LL}(k)=\sum_{l=D}^{\infty}\Phi_{xx}(k-l)\cdot A\cdot B^{l-D} \quad (6)$$

The decay of the late reverberation can equivalently be formulated recursively, as set forth below:

$$\tilde{\Phi}_{LL}(k)=B\cdot\tilde{\Phi}_{LL}(k-1)+A\cdot\Phi_{xx}(k-D) \quad (7)$$

Figure 4A:
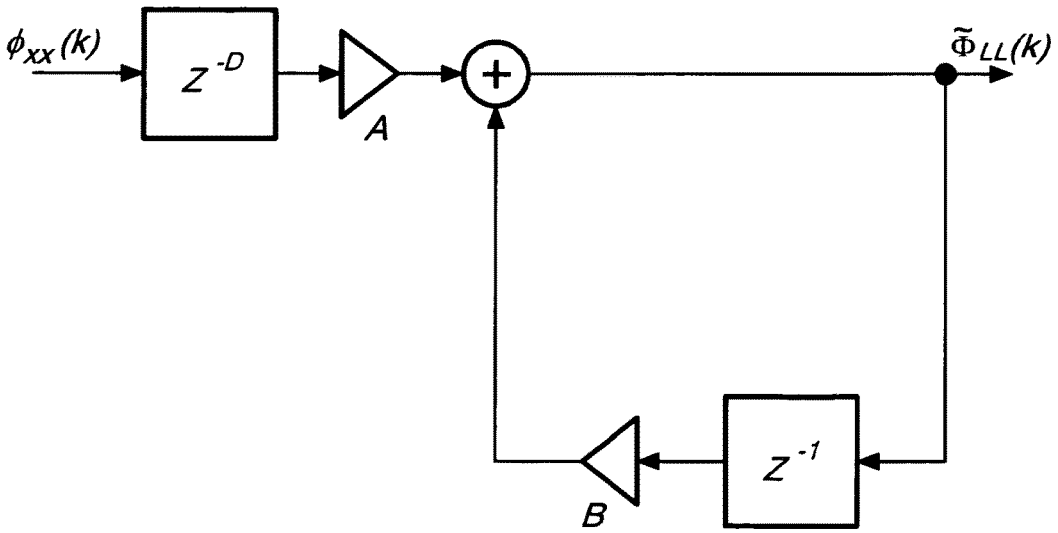
FIG. 4A is a schematic representation of an IIR model for late residual PSD.

It should be noted, however, that this recursion can be used to estimate the late RSV from the non-reverberant PSD of the reference (use-case of acoustic echo cancellation) as well as from the reverberant PSD of a microphone signal, such as in beamforming. The parameters A and B, should be chosen differently. FIG. 4A shows a first order IIR implementation for late residual interference PSD $\tilde{\Phi}_{LL}(k)$.

In embodiments of the invention, three parameters A, B and C are used for estimating the residual interference PSD $\Phi rr(k)$ on the basis of the accessible PSD reference signal $\Phi xx(k)$. A method for estimating A, B, while neglecting the influence of $\Phi\epsilon\epsilon(k)$, is described above. In accordance with illustrative embodiments, parameter estimation is provided which considers both, $\Phi\epsilon\epsilon(k)$ and $\Phi_{LL}(k)$.

Once the adaptive filter has converged sufficiently, parameters A and B can be extracted from the filter coefficients $H_l(k)$. In one embodiment, A and B can be found by fitting a substantially straight line to the log $(|H_l(k)|^2)$, based on the assumption that the PSD of the echo component also decays exponentially in the window that is covered by the AIC (time lags 0; : : : ; D−1), and therefore, requires a sufficiently long AIC Filter.

In accordance with illustrative embodiments, knowledge about A and B can be used to estimate the parameter C. For time instances when the input signal Y(k) comprises mainly interference (other components like desired speech or local noise are much smaller) the AIC output PSD $\Phi ee(k)$ (which is accessible) is approximately equal to the residual interference PSD $\tilde{\Phi}rr(k)$. Then, the third parameter C can be estimated as follows:

$$C=\frac{\Phi_{ee}(k)-\tilde{\Phi}_{LL}(k)}{\sum_{l=0}^{D-1}\Phi_{xx}(k-l)} \quad (8)$$

It is understood that smoothing can be applied, as well as gradient descent techniques, to find C in an iterative way.

For finding the model parameters without relying on the AIC-filter, embodiments provide signal-based processing. To find the parameters, gradient descent processing is employed that minimizes the error in the mean square sense, as follows:

$$\overline{\{\Phi_{rr}(k)-\Phi_{rr}(k)\}^2}\rightarrow\text{MIN} \quad (9)$$

whereas, $\tilde{\Phi}rr(k)=\tilde{\Phi}ee(k)+\tilde{\Phi}_{LL}(k)$ is the RSV estimate by the model and $\Phi rr(k)$ is the true RSV.

Figure 5:
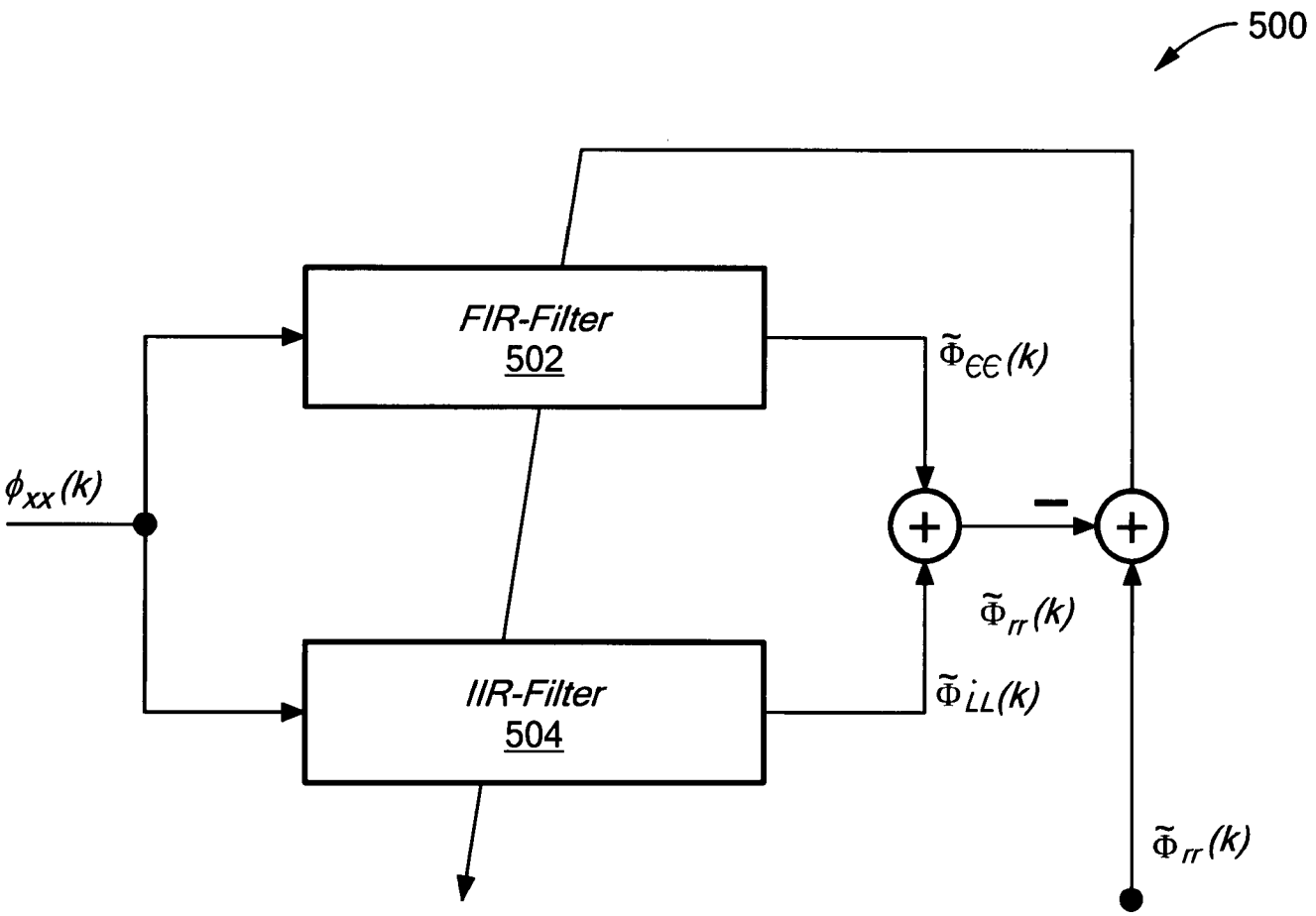
FIG. 5 is a schematic representation of a system to minimize output error.

FIG. 5 shows an illustrative adaptive filter structure 500 having a FIR filter 502 and a IIR filter 504 for iteratively estimating interference parameters. The IIR component 504 can be handled using the so called equation error principle which breaks up the recursive loop and adapts a feed-forward system instead, which converges to the correct solution.

Figure 5A:
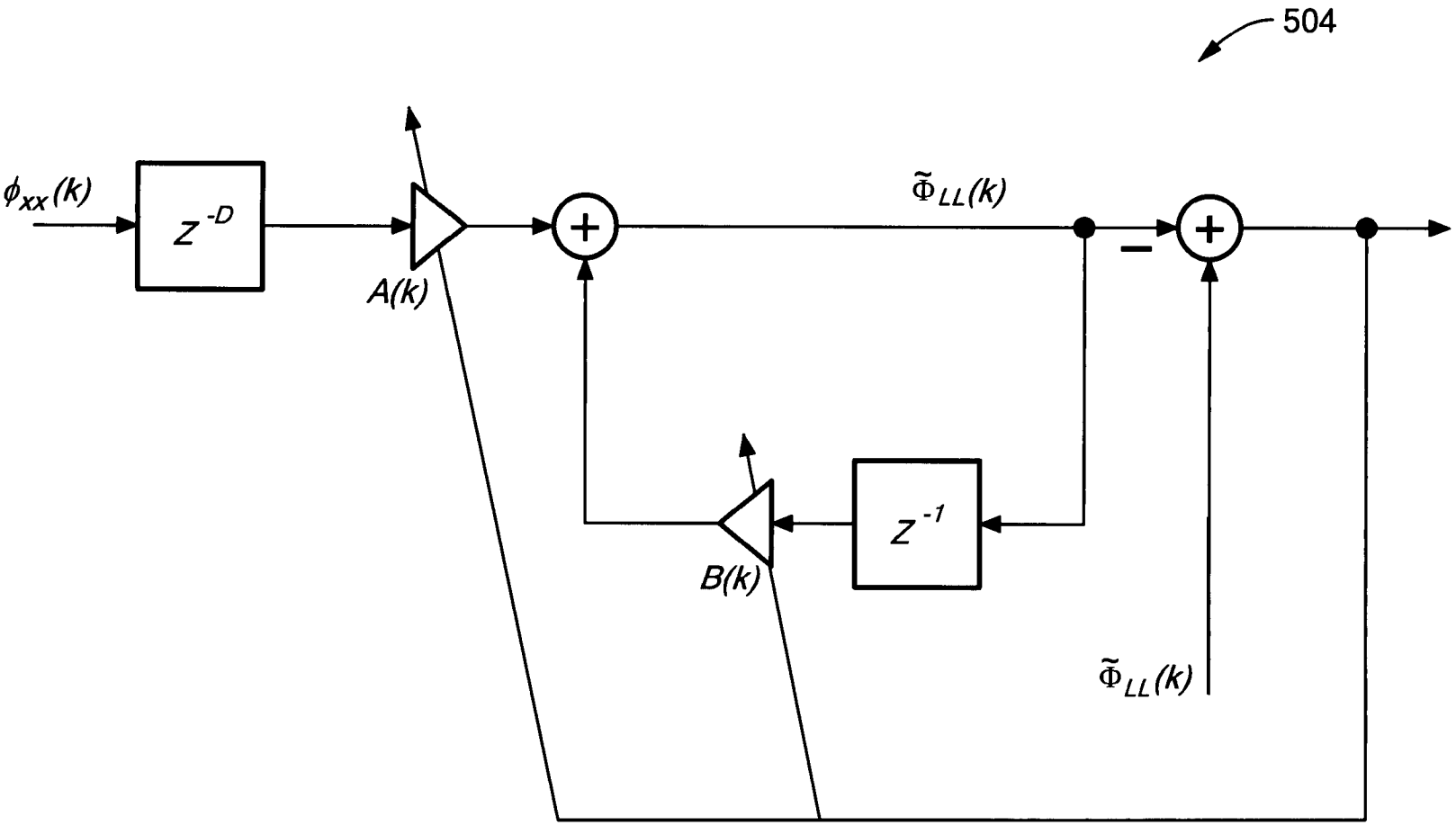
FIG. 5A is a schematic representation of a system for adaptation of an IIR filter.
Figure 5B:
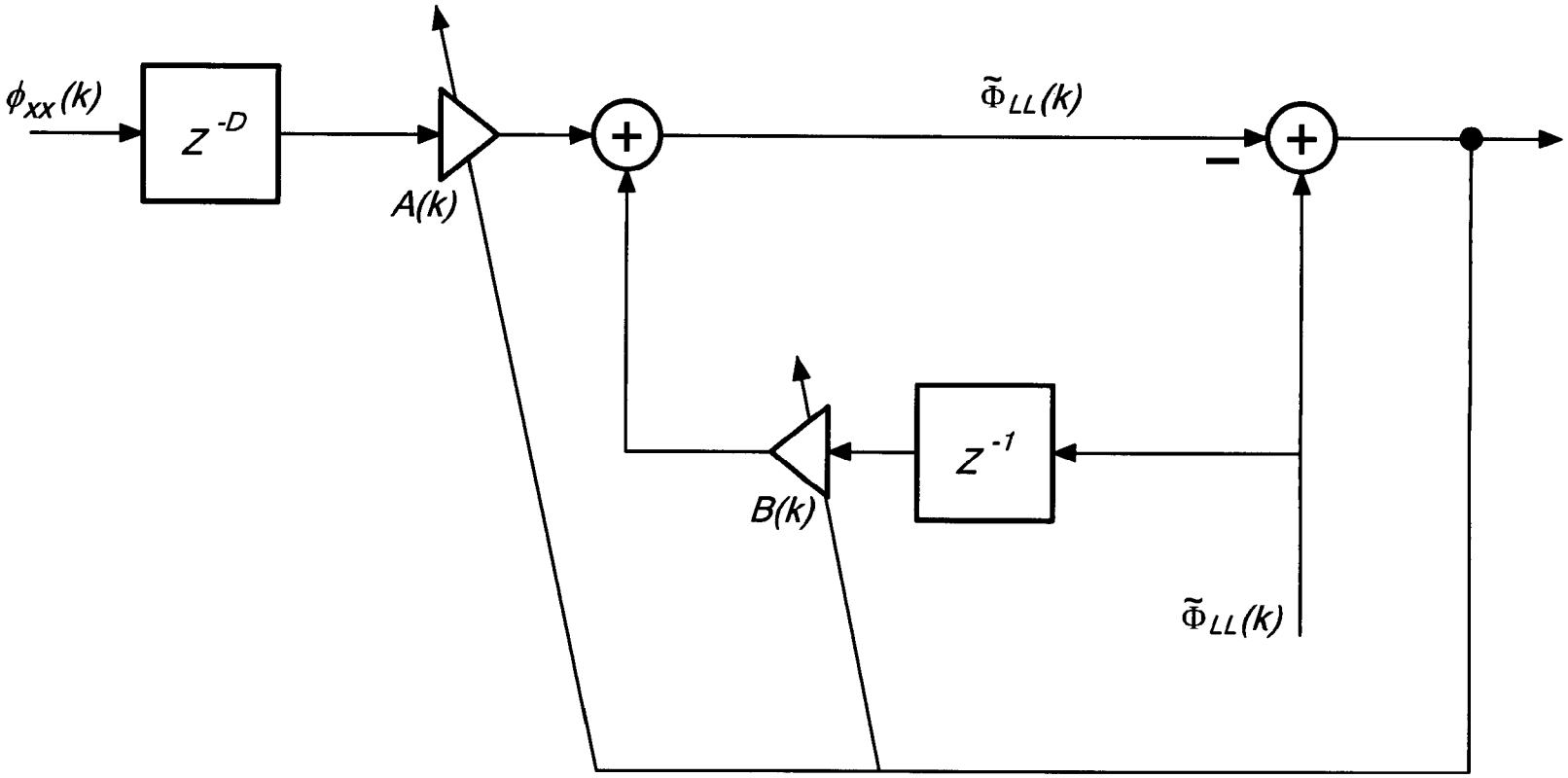
FIG. 5B is a schematic representation of a further system for adaptation of an IIR filter converted into an FIR filter using the equation error principle.

FIG. 5A shows an illustrative adaptive IIR filter 504 implementation with the regular principle. FIG. 5B shows a further adaptive IIR filter implementation for the equation error principle. In contrast to the system depicted in FIG. 5A, the recursive path in FIG. 5B with the parameter B is driven by the desired signal $\Phi_{LL}(k)$ rather than $\tilde{\Phi}_{LL}(k)$. This has the effect of breaking up the recursive IIR structure and converting the whole system into a feed-forward system (FIR). Thus, this structure ensures stability of the system and hence makes it easier to adapt.

Figure 6:
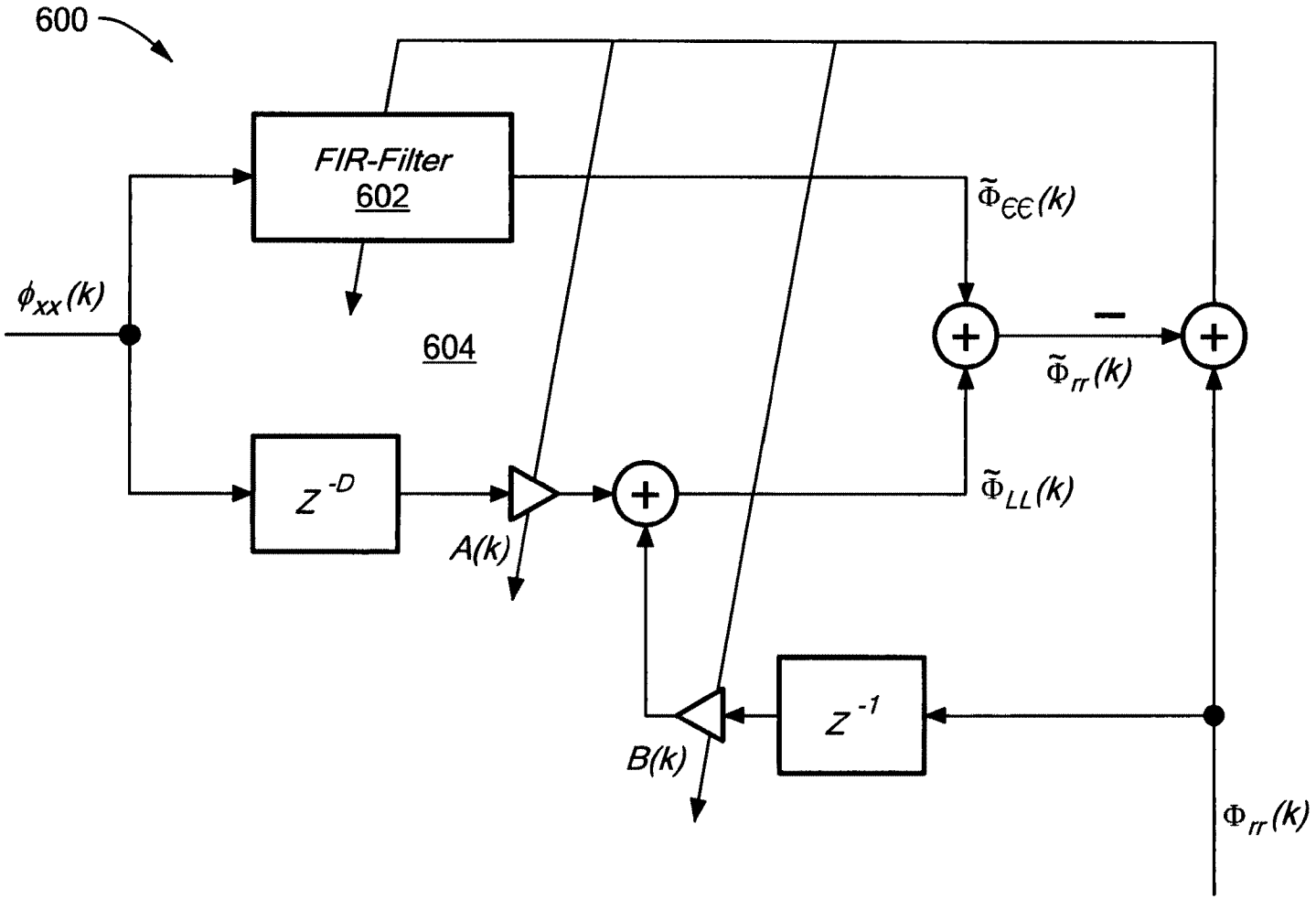
FIG. 6 is a schematic representation of an adaptive filter structure.
Figure 6A:
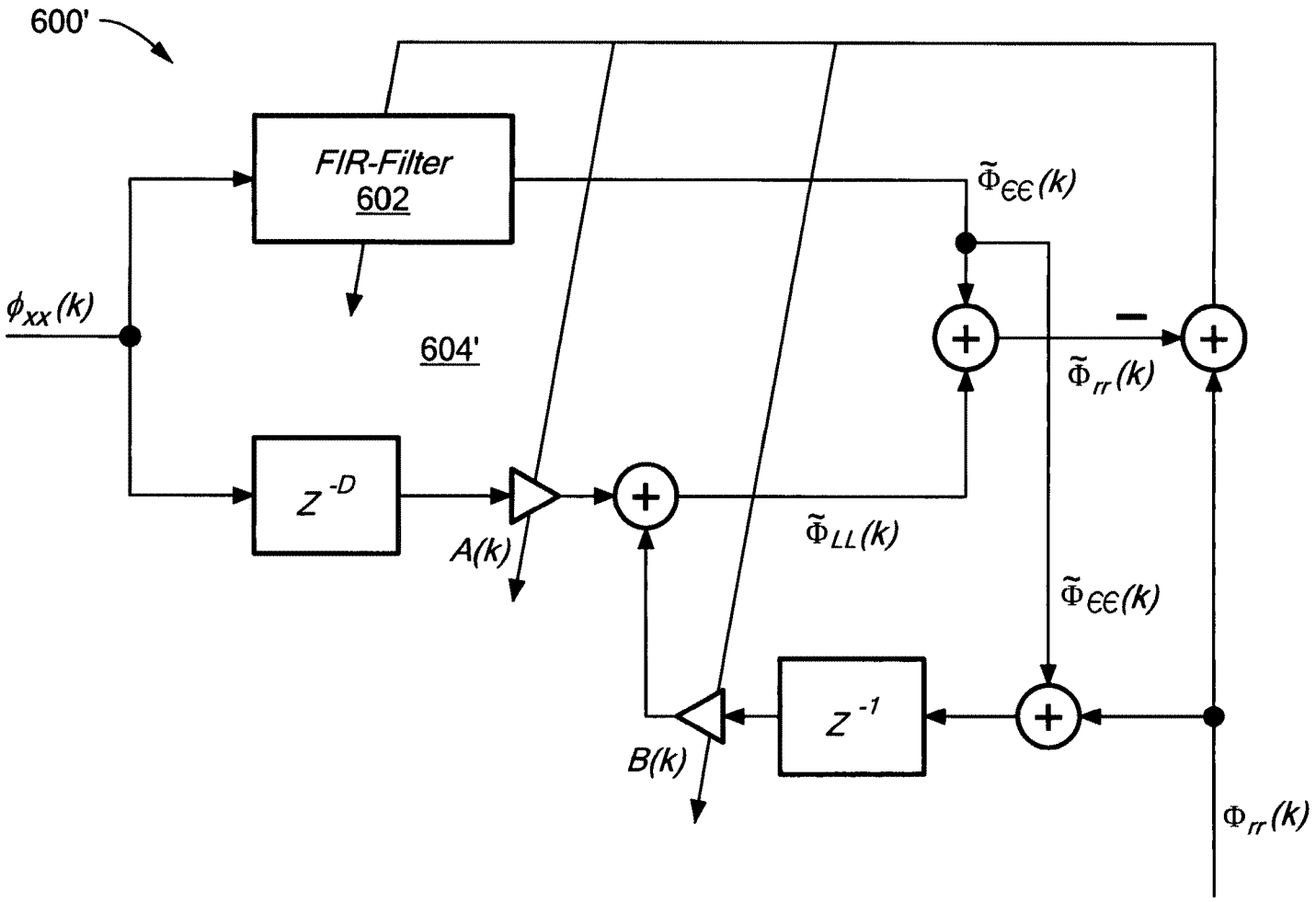
FIG. 6A is a schematic representation of a further adaptive filter structure.

FIG. 6 shows an overall adaptive filter system 600 having a FIR filter 602 and an IIR filter 604 for iteratively estimating interference parameters in accordance with the so-called "equation error principle." FIG. 6A shows an equation error-based filter system where the estimated PSD of the early residual interference is subtracted from the excitation of the recursion parameter B(k).

For the FIR part, the adaptation can be computed as:

$$K_l(k+1) = K_l(k) + \mu \cdot \frac{(\Phi_{rr}(k) - \tilde{\Phi}_{rr}(k)) \cdot \Phi_{xx}(k-l)}{\sum_{n=0}^{D} \Phi_{xx}^2(k-n) + \Phi_{rr}^2(k-1)} \forall\, l \in (0, \ldots, D-1) \tag{10}$$

Where, μ denotes the stepsize. Please note that the normalization term in the denominator includes the D-th input tap that excites the late reverb model. Also, the excitation of the coefficient B is contained in the normalization. If the FIR-model is simplified to the parameter C (assuming all FIR coefficients have the same value), even simpler schemes like the "sign-algorithm" can be used instead. This only evaluates the sign of the gradient resulting in a fixed increase of C if the estimated PSD is too small and a decrease in the opposite case—a logarithmic error function can also be used to find C. The NLMS update of the parameters A and B reads as follows:

$$A(k+1) = A(k) + \mu \cdot \frac{(\Phi_{rr}(k) - \tilde{\Phi}_{rr}(k)) \cdot \Phi_{xx}(k-D)}{\sum_{n=0}^{D} \Phi_{xx}^2(k-n) + \Phi_{rr}^2(k-1)} \tag{11}$$

$$B(k+1) = B(k) + \mu \cdot \frac{(\Phi_{rr}(k) - \tilde{\Phi}_{rr}(k)) \cdot \Phi_{xx}(k-1)}{\sum_{n=0}^{D} \Phi_{xx}^2(k-n) + \Phi_{rr}^2(k-1)} \tag{12}$$

To increase robustness, the temporal context in the error function (Eq. 9) can be utilized. This can for instance be achieved by exponential forgetting. A sliding window may also be used but consumes more memory.

As an alternative to the MSE cost function given in Eq. 10, a logarithmic error function may be minimized as follows:

$$\overline{\{\log\{\Phi_{rr}(k)\} - \log\{\tilde{\Phi}_{rr}(k)\}\}^2} \rightarrow \text{MIN} \tag{13}$$

The corresponding gradient descent update rule for the FIR filter can be provided as follows:

$$K_l(k+1) = K_l(k) \cdot \left(1 + \mu \cdot \log\left\{\frac{\Phi_{rr}(k)}{\tilde{\Phi}_{rr}(k)}\right\} \cdot \frac{\Phi_{xx}(k-l)}{\tilde{\Phi}_{rr}(k)}\right) \forall\, l \in (0, \ldots, D-1) \tag{14}$$

The parameters A and B are updated as follows:

$$A(k+1) = A(k) \cdot \left(1 + \mu \cdot \log\left\{\frac{\Phi_{rr}(k)}{\tilde{\Phi}_{rr}(k)}\right\} \cdot \frac{\Phi_{xx}(k-D)}{\tilde{\Phi}_{rr}(k)}\right) \tag{15}$$

$$B(k+1) = B(k) \cdot \left(1 + \mu \cdot \log\left\{\frac{\Phi_{rr}(k)}{\tilde{\Phi}_{rr}(k)}\right\} \cdot \frac{\Phi_{rr}(k-1)}{\tilde{\Phi}_{rr}(k)}\right) \tag{16}$$

A further refinement of this adaptation is to subtract the estimated PSD of the early residual interference $\tilde{\Phi}_{\epsilon\epsilon}(k)$ from Φrr(k) before feeding it into B(k), as depicted in FIG. 6A. As for the FIR part, logarithmic cost functions can be applied as well to find A and B by gradient descend.

In embodiments, based on the three parameters A, B, and C the residual interference PSD Φrr(k) is estimated. The PSD of the error signal Φee(k) can be directly accessed. The weighting filter W(k) for the RIS according to the Wiener filter rule is:

$$W(k) = 1 - \frac{\Phi_{rr}(k)}{\Phi_{ee}(k)} \tag{17}$$

W(k) is then applied to E(k) to obtain a further enhanced output signal with suppressed interference:

$$E_{enhanced}(k) = E(k) \cdot W(k) \tag{18}$$

This model helps to estimate Φrr(k) more accurately and thus reduce the speech distortion which comes due to estimation errors.

Figure 7:
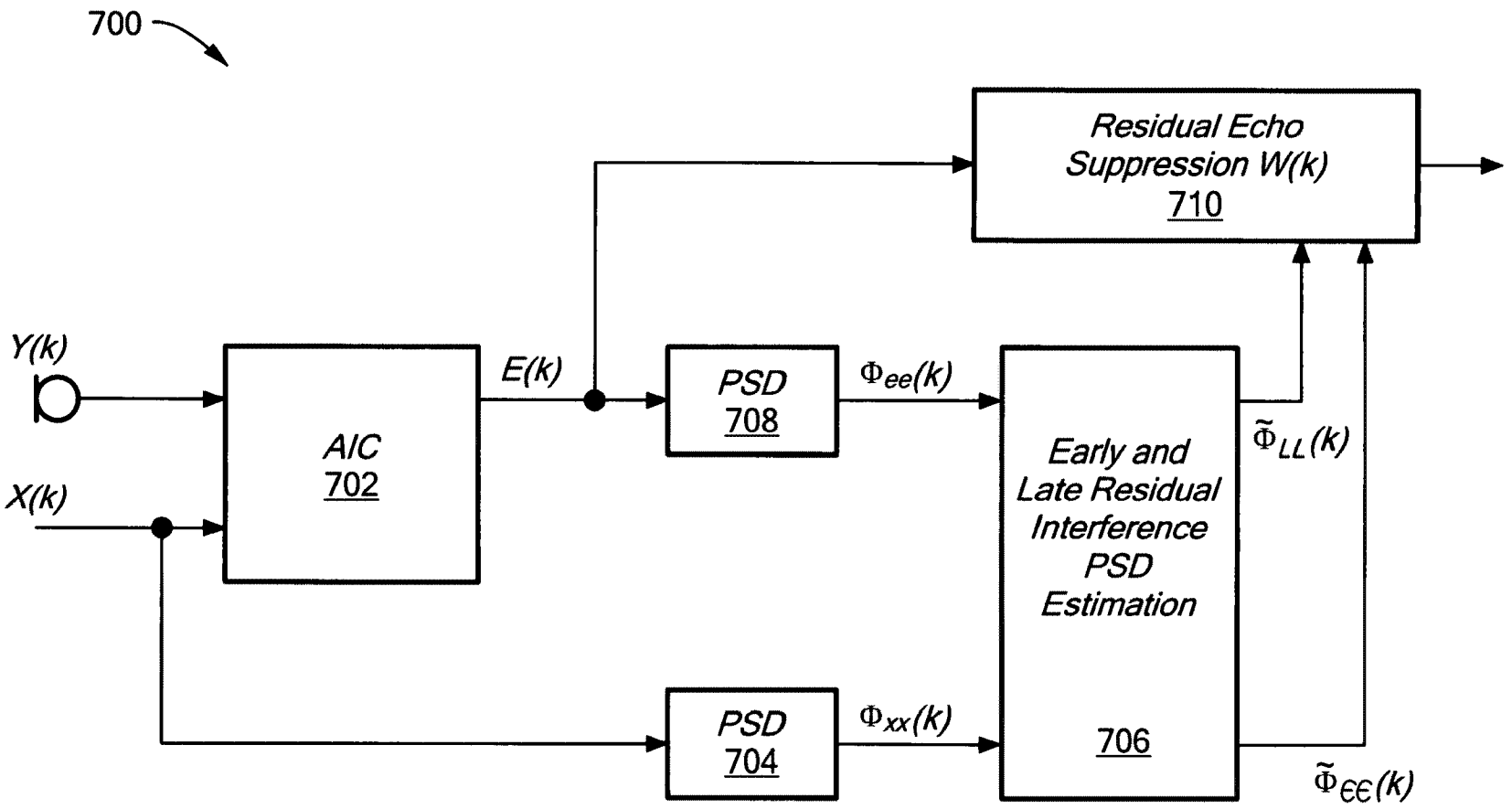
FIG. 7 is a schematic representation of a system for generating an estimate of the residual interference PSD to be used for residual echo suppression.

FIG. 7 shows an implementation of joint estimation of early and late residual interference PSDs for the case of acoustic echo cancellation. The resultant PSD estimates can be used for enhanced residual echo suppression. A microphone signal Y(k) and a reference signal X(k) are provided to an AIC module 702. The reference signal X(k) is also provided to a PSD module 704 coupled to an early and late residual interference PSD estimation module 706. The AIC output is coupled to a PSD module 708 and a residual echo suppression module 710, which also receives the early and late outputs from the early and late residual interference PSD estimation module 706.

For adaptation of the filter $H_l(k)$ normalized least-mean square (NLMS) processing can be applied, as follows:

$$H_l(k+1) = H_l(k) + \mu(k) \frac{E^*(k) X(k-l)}{\sum_{n=0}^{D-1} |X(k-n)|^2} \tag{19}$$

The optimal step size for adaptation can be computed as:

$$\mu(k) = \frac{\Phi_{\epsilon\epsilon}(k)}{\Phi_{ee}(k)} \tag{20}$$

Control of the step size μ(k) enables good convergence behavior. In embodiments, one aim is to get a better estimate of the residual of Φεε(k) and thus, to a better convergence of the AIC filter. Generally, the dynamic step size enables the filter to adapt (and converge) quickly when Φεε(k) is large (i.e., the filter is not well converged) and also ensures that the filter adapts slowly when Φεε(k) is small (i.e., it prevents the filter from losing good convergence). A benefit of modelling the late reverb here is to get an estimate for the early residual PSD that is not affected by the late residual PSD. As a consequence, the AIC-step-size will be small even if there is significant late reverberant energy. This improves the convergence of the AIC-filter compared to conventional AIC control methods.

Depending on the acoustic enclosure, the reverberation time T60 (and thus the reverberation tail/length of the room impulse response) is different. The length of the adaptive filter should be chosen according to the T60 (A large T60 requires a longer adaptive filter). Mobile devices, for example, are used in different acoustic environments with very different T60s. Thus, it may be desirable to adjust D dynamically.

Based on our model parameters the length D of the adaptive filter can be adjusted automatically using a variety of criteria. From parameter B the T60 can be calculated. The length D can be set to a certain (predefined) percentage of T60 (e. g. 60). Another criterion could be that the ratio of the two error portions equal a certain (predefined) value Q when the filter has converged sufficiently, e.g.: $\Phi\epsilon\epsilon(k)/\Phi_{LL}(k)\approx Q$. It is understood that instead of/alternatively to this ratio a formula can use purely model parameters.

Figure 7A:
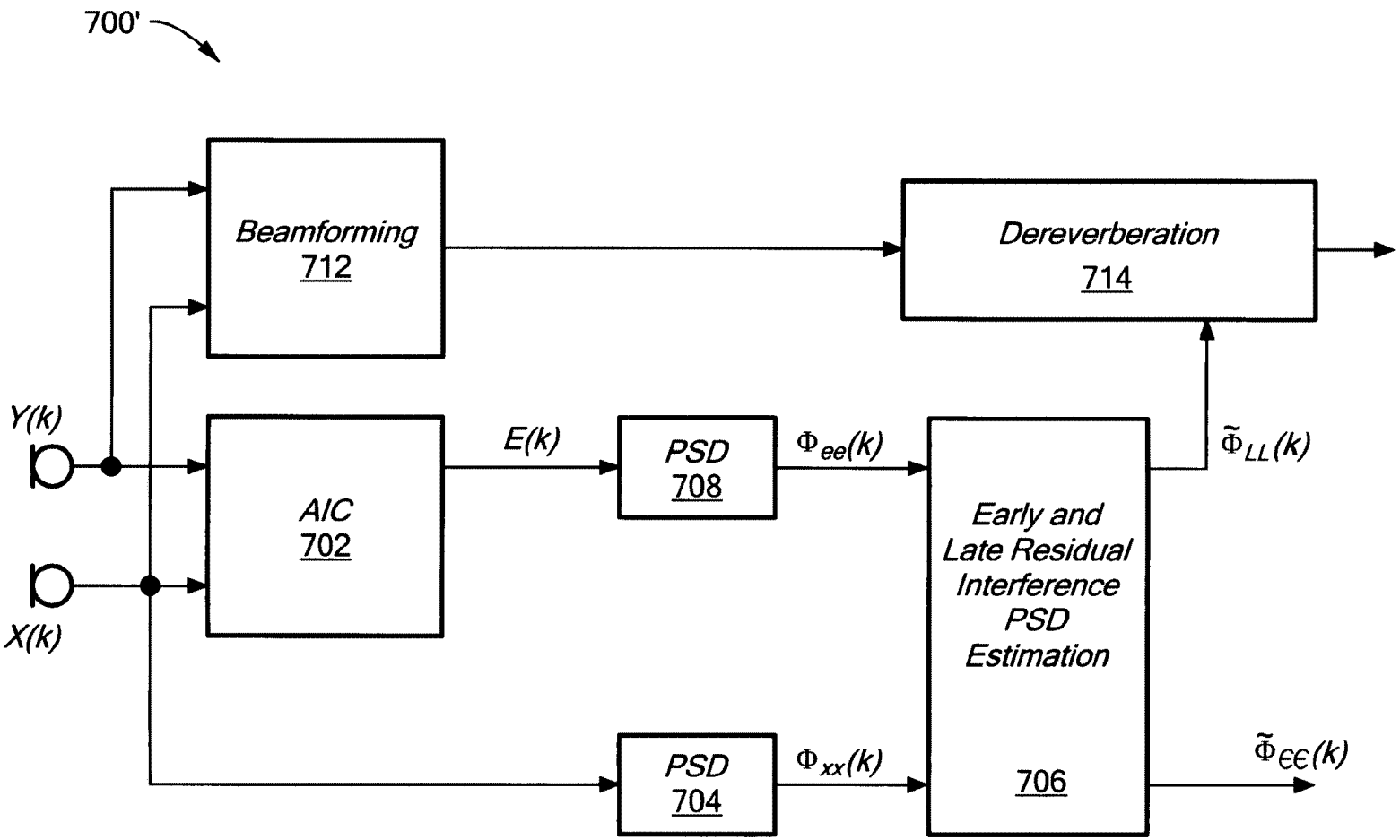
FIG. 7A is a schematic representation of a system for generating and using a residual estimate for late reverberation suppression at beamformer output.
Figure 7B:
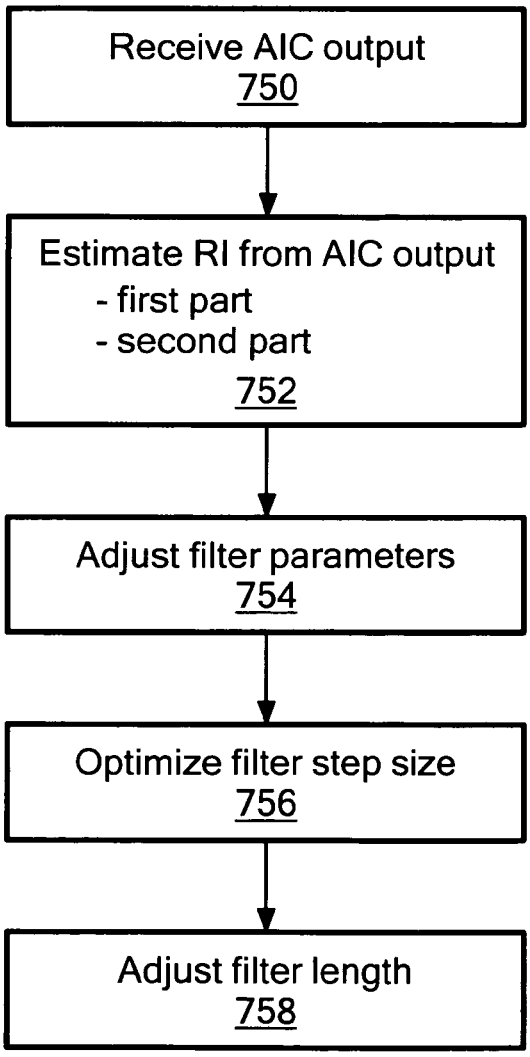
FIG. 7B is a flow diagram for an illustrative sequence of steps for residual interference suppression.

FIG. 7A, which has some commonality with FIG. 7, shows use of the improved estimate for late reverberation suppression at the output of a beamformer. A beamforming module 712 receives microphone signals X(k) and Y(k) and provides an output to a dereverberation module 714.

In a beamforming context, where the AIC module 702 is used for enhanced signal blocking, the described estimator for the late reverb 706 can be applied to perform dereverberation 714 on the output signal of the beamformer 712. Thereby, the early reverberation components will not be suppressed as they had been identified by the joint model and are explicitly not fed into the dereverberation filter 714 as illustrated. The blocking matrix gives the AIC filter output for estimating the parameters of a reverberation model.

Conventional spatial postfilter techniques can use the blocked PSD Φee(k) directly for suppressing the reverb, but may suffer from the early reverb components leading to degradations of the desired signal.

FIG. 7A shows an illustrative sequence of steps for residual interference suppression processing. In step 700, an AIC output signal having residual interference is received. In step 752, the residual interference is estimated including estimating a power spectral density of a first part of the residual interference corresponding to early reverberation and a second part corresponding to late reverberation. In one embodiment, the first part is estimated using a real-valued FIR filter operating on a power spectral density (PSD) of a reference signal and the second part is estimated using an exponential decay over time corresponding to a reverberation time using the PSD of the reference signal. In step 754, filter parameters can be adjusted. In step 756, a filter step size can be optimized for filter convergence. In step 758, a filter length can be adjusted based upon the reverberation time.

Figure 8:
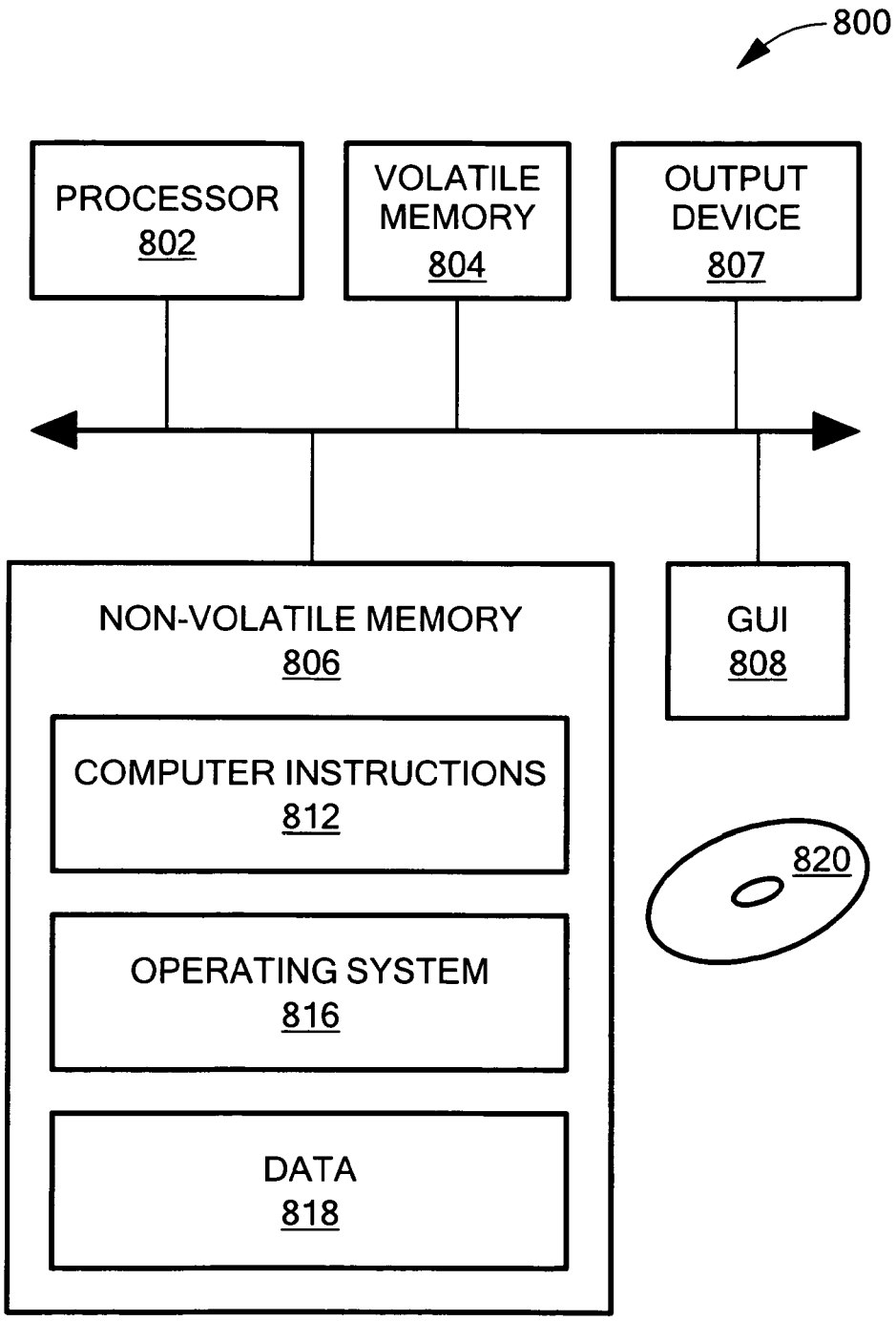
FIG. 8 is a schematic representation of an illustrative computer that can perform at least a portion of the processing described herein.

FIG. 8 shows an exemplary computer 800 that can perform at least part of the processing described herein. The computer 800 includes a processor 802, a volatile memory 804, a non-volatile memory 806 (e.g., hard disk), an output device 807 and a graphical user interface (GUI) 808 (e.g., a mouse, a keyboard, a display, for example). The non-volatile memory 806 stores computer instructions 812, an operating system 816 and data 818. In one example, the computer instructions 812 are executed by the processor 802 out of volatile memory 804. In one embodiment, an article 820 comprises non-transitory computer-readable instructions.

Processing may be implemented in hardware, software, or a combination of the two. Processing may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform processing and to generate output information.

The system can perform processing, at least in part, via a computer program product, (e.g., in a machine-readable storage device), for execution by, or to control the operation of, data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer. Processing may also be implemented as a machine-readable storage medium, configured with a computer program, where upon execution, instructions in the computer program cause the computer to operate.

Processing may be performed by one or more programmable processors executing one or more computer programs to perform the functions of the system. All or part of the system may be implemented as, special purpose logic circuitry (e.g., an FPGA (field programmable gate array) and/or an ASIC (application-specific integrated circuit)).

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method of reducing a residual interference in an output signal from an adaptive interference cancellation (AIC) module that operates on an input signal and a reference signal, the output signal comprising a corrected input signal superposed with the residual interference, the method comprising:

by a power spectral density (PSD) module, forming a time series of PSD values for the reference signal;

by a real-valued finite impulse response (FIR) forming an AIC filter misalignment estimate signal by operating on the time series of PSD values;

by a reverberation filter, forming a late reverberation estimate signal using an exponential decay over time using the time series of PSD values; and subtracting the AIC filter misalignment estimate signal and the late reverberation estimate signal from the AIC module output signal.

2. The method according to claim 1, wherein the reverberation filter comprises an infinite impulse response (IIR) filter.

3. The method according to claim 2, wherein the FIR filter has a number of taps.

4. The method according to claim 3, wherein the IIR filter includes a delay element with delay proportional to the number of taps.

5. The method according to claim 3, further including using the same weight for all taps.

6. The method according to claim 1, further including estimating a residual interference using gradient descent by the FIR filter, the reverberation filter, or both.

7. The method according to claim 6, further including receiving, by the reverberation filter as an input, a non-estimated reverberation signal.

8. The method according to claim 6, further including the gradient descent using a logarithmic cost function.

9. The method according to claim 1, further including:

determining a parameter A in the reverberation filter for a strength of a late reverberation;

determining a parameter B in the reverberation filter for an exponential decay of the late reverberation in relation to reverberation time of an enclosure; and adapting a parameter C, in the FIR filter for scaling the AIC filter misalignment estimate signal, as a function of a time series of PSD values for the output signal and a time series of PSD values for the late reverberation estimate signal.

10. The method according to claim 9, wherein determining the parameters A and B includes fitting a substantially straight line to the logarithm of the magnitude of coefficients in a filter of the AIC module.

11. The method according to claim 1, further including controlling a step size of the AIC module.

12. The method according to claim 11, further including dynamically adjusting a length of the FIR filter corresponding to a reverberation time and/or the ratio of early and late residual interference.

13. The method according to claim 1, wherein the reference signal comprises a loudspeaker signal and the residual interference PSD estimate is applied for residual echo suppression.

14. The method according to claim 1, wherein the reference signal is a microphone signal and the second component corresponding to the PSD of the late reverberation is used for dereverberation.

15. An article, comprising a non-transitory storage medium having stored instructions that enable a machine to perform a method of reducing a residual interference in an output signal from an adaptive interference cancellation (AIC) module that operates on an input signal and a reference signal, the output signal comprising a corrected input signal superposed with the residual interference, the method comprising;

by a power spectral density (PSD) module, forming a time series of PSD values for the reference signal;

by a real-valued finite impulse response (FIR) filter, forming an AIC filter misalignment estimate signal by operating on the time series of PSD values;

by a reverberation filter, forming a late reverberation estimate signal using an exponential decay over time as a function of the time series of PSD values; and subtracting the AIC filter misalignment estimate signal and the late reverberation estimate signal from the AIC module output signal.

16. The article according to claim 15, wherein the reverberation filter comprises an infinite impulse response (IIR) filter.

17. A system, comprising:

an adaptive interference cancellation (AIC) module to receive an input signal and a reference signal and generate an AIC output signal comprising a corrected input signal superposed with a residual interference;

a first power spectral density (PSD) module to receive the AIC output signal and generate a first PSD output signal;

a second PSD module to receive the reference signal and generate a second PSD output signal;

a real-valued finite impulse response (FIR) filter to receive the second PSD output signal and form an AIC filter misalignment estimate output;

a reverberation filter to receive the second PSD output signal and form a late reverberation estimate output; and a residual echo suppression module to process the AIC filter misalignment estimate output, the late reverberation estimate output, and the AIC output.

18. A system, comprising:

an adaptive interference cancellation (AIC) module to receive an input signal and a reference signal and generate an AIC output signal comprising a corrected input signal superposed with a residual interference;

a first power spectral density (PSD) module to receive the AIC output signal and generate a first PSD output signal;

a second PSD module to receive the reference signal and generate a second PSD output signal;

a real-valued finite impulse response (FIR) filter to receive the second PSD output signal and form an AIC filter misalignment estimate output;

a reverberation filter to receive the second PSD output signal and form a late reverberation estimate output;

a beamforming module to receive the input signal and the reference signal and generate a beamforming output signal; and a dereverberation module to process the late reverberation estimate output and the beamforming output, wherein the AIC filter misalignment estimate output is not processed by the dereverberation module.

* * * * *